United States Patent [19]

Watanabe et al.

[11] Patent Number: 4,638,268

[45] Date of Patent: Jan. 20, 1987

[54] MICROWAVE ABSORBER COMPRISED OF A DENSE SILICON CARBIDE BODY WHICH IS WATER COOLED

[75] Inventors: Masakazu Watanabe; Akiyasu Okuno, both of Aichi, Japan

[73] Assignee: NGK Spark Plug Co., Ltd., Aichi, Japan

[21] Appl. No.: 634,012

[22] Filed: Jul. 24, 1984

[30] Foreign Application Priority Data

Nov. 8, 1983 [JP] Japan ..... 58-171958[U]

[51] Int. Cl.[4] ..... H01P 1/26

[52] U.S. Cl. ..... 333/22 F; 338/216

[58] Field of Search ..... 333/22 F, 22 R, 81 B; 219/10.55 A, 10.65; 338/53, 55, 216, 223, 224

[56] References Cited

U.S. PATENT DOCUMENTS 2,908,875 10/1959 Blatt et al. ..... 333/22 R
3,040,252 6/1962 Novak ..... 333/22 F X
3,241,089 3/1966 Treen ..... 333/22 F
3,509,496 4/1970 Griffin et al. ..... 333/22 R

FOREIGN PATENT DOCUMENTS 2414256 9/1979 France ..... 333/22 F
0047750 4/1978 Japan ..... 333/22 R

*Primary Examiner*—Eugene R. LaRoche
*Assistant Examiner*—Benny T. Lee
*Attorney, Agent, or Firm*—Sughrue, Mion, Zinn, Macpeak & Seas

[57] ABSTRACT

A microwave absorber, particularly, a microwave absorber intended for use in an electron beam accelerator, having an increased maximum power characteristic. The microwave absorber is formed of a body of dense silicon carbide having a hollow portion and a closed tip end portion. A pipe of high melting point glass or alumina is inserted into the hollow portion. Cooling water is guided through the pipe and circulated through the hollow portion of the body of the absorber.

3 Claims, 7 Drawing Figures

MICROWAVE ABSORBER COMPRISED OF A DENSE SILICON CARBIDE BODY WHICH IS WATER COOLED

BACKGROUND OF THE INVENTION

The present invention relates to an electromagnetic wave absorber, and particularly to a microwave absorber intended for use in an electron beam accelerator.

In an electron beam accelerator, a high-frequency high-power signal is generated by a klystron and supplied to an acceleration tube where an electron beam is accelerated to near light velocity by the electric field applied within the acceleration tube. It is necessary to absorb excess amounts of energy used for accelerating the electron beam and to discharge the absorbed energy in the form of heat to thereby assure the safety of the device. Further, in the case where a power divider is used, it is necessary to absorb power reflected from a load side to protect the klystron. To this end, it is required to provide a wave absorber at an end portion of the acceleration tube or a branch portion of the power divider to thereby absorb unnecessary electromagnetic waves. As such a wave absorber, conventionally, an indirect cooling type microwave absorber composed of dense silicon carbide has been proposed by the present inventor and disclosed in Japanese Patent Application No. 135205/1982. In this indirect cooling type microwave absorber, however, there is a disadvantage in that the power reflection factor becomes larger as the power is increased, resulting in a gradual deterioration of the absorption characteristic and hence a limitation in the power rating of the absorber.

SUMMARY OF THE INVENTION

As a result of research, it has been found that, in this indirect cooling type microwave absorber, it is impossible to sufficiently discharge the heat generated in the microwave absorber and that the absorbing characteristic is deteriorated by the temperature rise in the absorber. Accordingly, overcoming the drawbacks of the prior microwave absorber, the present invention provides a microwave absorber in which cooling water is fed into the inside of a silicon carbide sintered body constituting the absorber and the cooling water is circulated in the sintered body to directly cool the same to thereby suppress a temperature rise of the absorber. With this construction, even if the mean value of the generated power is increased to about ten times that of the conventional one, the absorber maintains an absorption factor of substantially 100% so that the absorber operates efficiently at all times.

DESCRIPTION OF THE PREFERRED EMBODIMENTS

Figure 1:
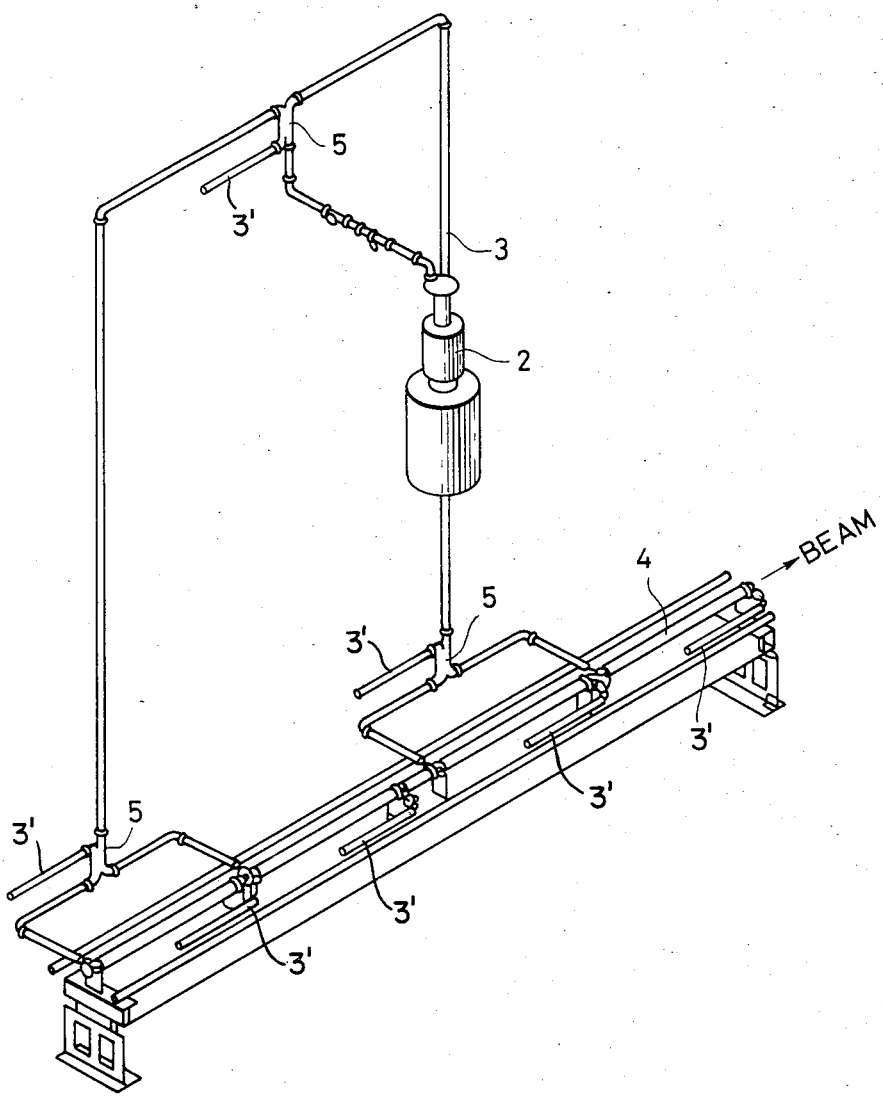
FIG. 1 is a diagram showing an electron beam accelerator unit in which the microwave absorber according to the present invention is employed.
Figure 4:
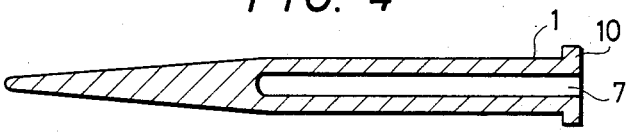
FIG. 4 is a longitudinal side cross-sectional view of a direct cooling type absorber according to the present invention.
Figure 5:
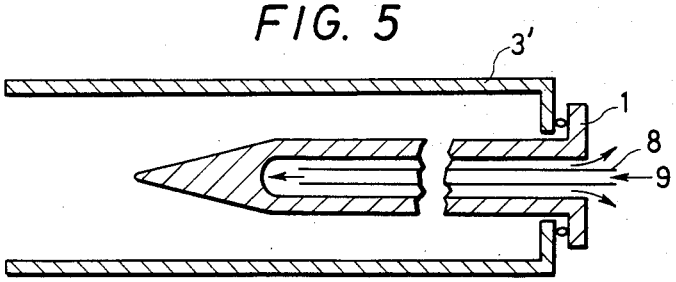
FIG. 5 is a diagram, similar to FIG. 3, showing the mounting of an absorber according to the present invention in a waveguide.

Referring to the drawings, a preferred embodiment of the present invention will be described. FIG. 1 shows an electron beam accelerator unit including waveguides 3' containing a microwave absorber 1 therein. The microwave absorber 1 is composed of a dense silicon carbide sintered body and provided with a hollow portion 7 with its tip end closed as shown in FIGS. 4 and 5. Into this hollow portion 7, a cooling pipe 8 of a high melting point glass such as PYREX (trademark) or alternatively of alumina for guiding cooling water is inserted so as to cause the cooling water 9 to circulate inside the hollow portion 7 through the pipe 8. A klystron 2 generates a high-frequency high-power signal which is supplied to a waveguide 4. Appropriate power dividers 5 are provided for the system. An accelerator apparatus is constituted by 40 accelerator units, each arranged as described above, and 160 accelerator tubes extending over a distance of 400 meters.

Figure 2:
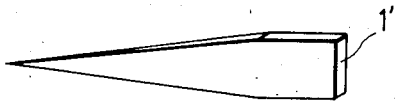
FIG. 2 PRIOR ART
FIG. 2 is a perspective view showing a conventional indirect cooling type absorber.
Figure 3:
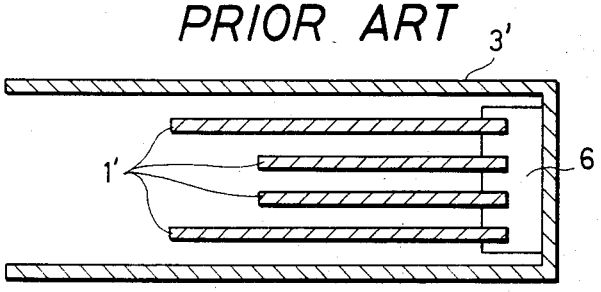
FIG. 3 PRIOR ART
FIG. 3 is a diagram showing the mounting of the conventional absorber in a high power test arrangement.

FIG. 2 shows a conventional indirect cooling type wedge-like microwave absorber 1', plural ones of which are mounted in a waveguide 3 or the like in the above-described accelerator apparatus as shown in FIG. 3. The absorbers 1' are attached to the inside end portion of the waveguide 3 through an aluminum plate 6 so that the heat absorbed by the absorbers 1' is conducted from the absorbers 1' through the aluminum plate 6. By cooling the aluminum plate 6, the absorbers 1' are indirectly cooled. In FIG. 3, four wedge-like absorbers 1' are provided.

Figure 6:
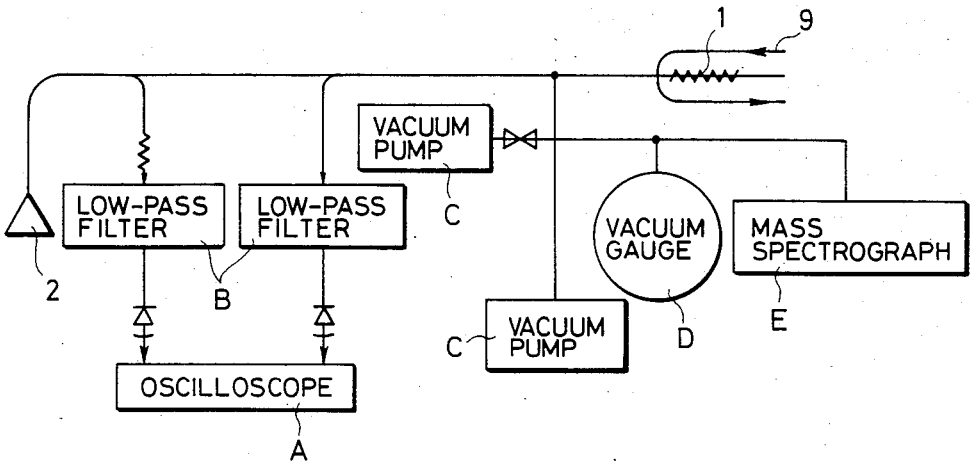
FIG. 6 is a diagram showing a circuit used for a high power test arrangement.

FIG. 6 shows a test apparatus used for comparing the performances of the above-mentioned conventional indirect cooling type silicon carbide absorbers and the direct cooling type silicon carbide absorbers according to the present invention. The results of tests using this device will be described below.

In FIG. 6, the test apparatus includes an oscilloscope A, low-pass filters B, high-vacuum pumps C, a vacuum gauge D, and a mass spectrograph E. The degree of vacuum in the waveguide 3 is measured by the vacuum gauge D and the mass of a discharged gas is recorded by the mass spectrograph E. A klystron 2 having an output power of 30 Mw, a pulse width of 3.3 μsec and a repetition rate of 50 pps was used in the tests. For these tests, silicon carbide absorbers 1 and 1' were coupled to the output of the klystron 2 as shown in FIGS. 5 and 3, respectively, and power was applied under vacuum conditions.

In the tests of the absorber of the invention, no discharge was observed at the maximum average power of 1.32 kw, proving that the absorber of the invention had a sufficient antidischarge characteristic. Further, the degree of vacuum and the mass of discharged gas during operation were measured using the vacuum gauge and the mass spectrograph, respectively. It was found that, although some gas was present on the surface of the silicon carbide body immediately after the start of the test, it was discharged by the high-frequency electric field, and the operation of the absorber stabilized immediately. The amount of gas discharge was very small.

Figure 7:
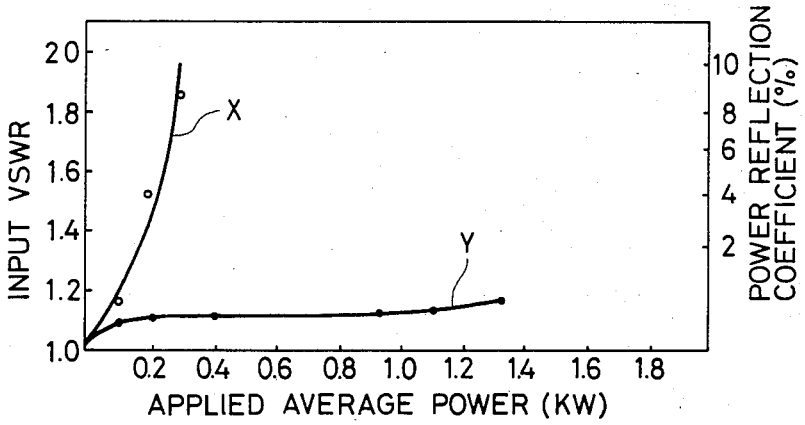
FIG. 7 is a graph showing the results of a comparison between an absorber according to the present invention and a conventional one.

As to the wave absorption performance, microwave energy at a frequency 2,856 MHz±10 MHz was applied at a maximum average power of 1.32 kw (8 Mw peak power, 3.3 μsec pulse width, 50 pps repetition rate). The VSWR (Voltage Standing Wave Ratio) and the power reflection coefficient were obtained from the ratio of the maximum amplitude of the standing wave pattern generated due to interference between a travelling wave and a reflected wave. The result is shown in FIG. 7 in which the curve X represents the result as to the conventional indirect cooling type absorber and the curve Y shows the result as to the direct cooling type absorber according to the present invention. FIG. 7 shows that, in the case where the absorber according to the present invention is used, although the VSWR increases gradually as the supplied power is increased, the VSWR is always 1.2 or less and the power absorption factor is 99% or more, even if the power reaches a value ten times as high as used with the conventional absorber.

The absorber according to the present invention can be used not only for an absorber for klystrons, but also as a high-frequency attenuator in a slow-wave circuit of a microwave electron tube such as a travelling wave tube, magnetron or the like, or as an absorber for use in an isolator or a circulator in an antenna, or as an radio-frequency dummy load in a high-frequency circuit.

We claim:

1. A microwave absorber comprising: a body entirely of dense silicon carbide having two ends, wherein a hollow portion is located at one end and a closed tip end portion is located at the other end, and a pipe, for guiding cooling water into said hollow portion.

2. The microwave absorber of claim 1, wherein said pipe is made of a high melting point glass.

3. The microwave absorber of claim 1, wherein said pipe is made of alumina.

* * * * *